US011906165B2

(12) United States Patent
Bucaro et al.

(10) Patent No.: US 11,906,165 B2
(45) Date of Patent: Feb. 20, 2024

(54) GAS TURBINE NOZZLE HAVING AN INNER AIR SWIRLER PASSAGE AND PLURAL EXTERIOR FUEL PASSAGES

(71) Applicant: General Electric Company, Schenectady, NY (US)

(72) Inventors: Michael T. Bucaro, Arvada, CO (US); Ajoy Patra, Bengaluru (IN); Pradeep Naik, Bengaluru (IN); Perumallu Vukanti, Bengaluru (IN); R Narasimha Chiranthan, Bengaluru (IN); Clayton S. Cooper, Evendale, OH (US); Michael A. Benjamin, Cincinnati, OH (US); Steven C. Vise, West Chester, OH (US); Manampathy G. Giridharan, Evendale, OH (US); Krishnakumar Venkatesan, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/717,739

(22) Filed: Apr. 11, 2022

(65) Prior Publication Data

US 2023/0194093 A1 Jun. 22, 2023

(30) Foreign Application Priority Data

Dec. 21, 2021 (IN) ..... 202111059813

(51) Int. Cl.
*F23R 3/14* (2006.01)
*F23R 3/28* (2006.01)

(52) U.S. Cl.
CPC ..... *F23R 3/14* (2013.01); *F23R 3/286* (2013.01)

(58) Field of Classification Search
CPC .... F23R 3/14; F23R 3/286; F23R 3/12; F23R 3/28; F23R 3/283
See application file for complete search history.

(56) References Cited

U.S. PATENT DOCUMENTS

| | | | | |
|---|---|---|---|---|
| 5,505,045 | A * | 4/1996 | Lee | F23R 3/14 60/737 |
| 5,761,907 | A * | 6/1998 | Pelletier | F23R 3/28 239/397.5 |
| 6,035,645 | A | 3/2000 | Bensaadi et al. | |
| 6,367,262 | B1 * | 4/2002 | Mongia | F23R 3/286 60/748 |
| 7,596,949 | B2 | 10/2009 | DeVane et al. | |
| 7,878,000 | B2 * | 2/2011 | Mancini | F23R 3/286 60/737 |

(Continued)

FOREIGN PATENT DOCUMENTS

| | | |
|---|---|---|
| CN | 101220953 B | 6/2012 |
| CN | 102165262 B | 3/2013 |

*Primary Examiner* — William H Rodriguez
(74) *Attorney, Agent, or Firm* — McGarry Bair PC

(57) ABSTRACT

An engine can utilize a combustor to combust fuel to drive the engine. A fuel nozzle assembly can supply fuel to the combustor for combustion or ignition of the fuel. The fuel nozzle assembly can include a swirler and a fuel nozzle to supply a mixture of fuel and air for combustion. The fuel nozzle can include both a primary and secondary fuel passage, and an additional air passage to provide for greater flame control, fuel provision, or local fuel and air mixing prior to combustion.

15 Claims, 11 Drawing Sheets

(56) References Cited

U.S. PATENT DOCUMENTS 8,104,285 B2 1/2012 Bonzani et al.
8,347,630 B2 1/2013 Lovett et al.
8,348,180 B2 * 1/2013 Mao ..... F23R 3/14 239/404
8,739,550 B2 6/2014 Etemad et al.
9,228,747 B2 1/2016 Prociw et al.
10,344,981 B2 7/2019 Prociw et al.
10,612,782 B2 * 4/2020 Toon ..... F23R 3/283
10,641,176 B2 5/2020 Berry et al.
10,731,861 B2 * 8/2020 Schlein ..... F23C 7/004
10,794,596 B2 * 10/2020 Dai ..... F23D 11/105
11,181,272 B2 * 11/2021 Tentorio ..... F23R 3/30
2002/0134084 A1 * 9/2002 Mansour ..... F23R 3/28 60/740
2004/0006993 A1 1/2004 Stuttaford et al.
2007/0137207 A1 * 6/2007 Mancini ..... F23R 3/286 60/737
2007/0277528 A1 * 12/2007 Homitz ..... F23D 14/08 60/737
2009/0044538 A1 * 2/2009 Pelletier ..... F23R 3/14 60/740
2010/0050644 A1 * 3/2010 Pidcock ..... F23R 3/343 60/737
2010/0251720 A1 * 10/2010 Pelletier ..... F23D 11/107 60/740
2012/0291447 A1 11/2012 Boardman et al.
2014/0291418 A1 * 10/2014 Ruffing ..... F02C 7/232 239/403
2015/0159874 A1 * 6/2015 Toon ..... F23R 3/283 60/737
2016/0215982 A1 * 7/2016 Pfeffer ..... F23R 3/14
2017/0082288 A1 * 3/2017 Ryon ..... F23R 3/28
2017/0130652 A1 * 5/2017 Siders ..... F02C 7/22
2017/0138600 A1 5/2017 Berry et al.
2017/0159561 A1 6/2017 Shershnyov et al.
2017/0159938 A1 * 6/2017 Barnhart ..... F23R 3/28
2019/0257520 A1 * 8/2019 Tibbs ..... F23R 3/14
2020/0003421 A1 * 1/2020 Sanchez ..... F23D 11/107
2020/0025386 A1 * 1/2020 Muldal ..... F23R 3/343

* cited by examiner

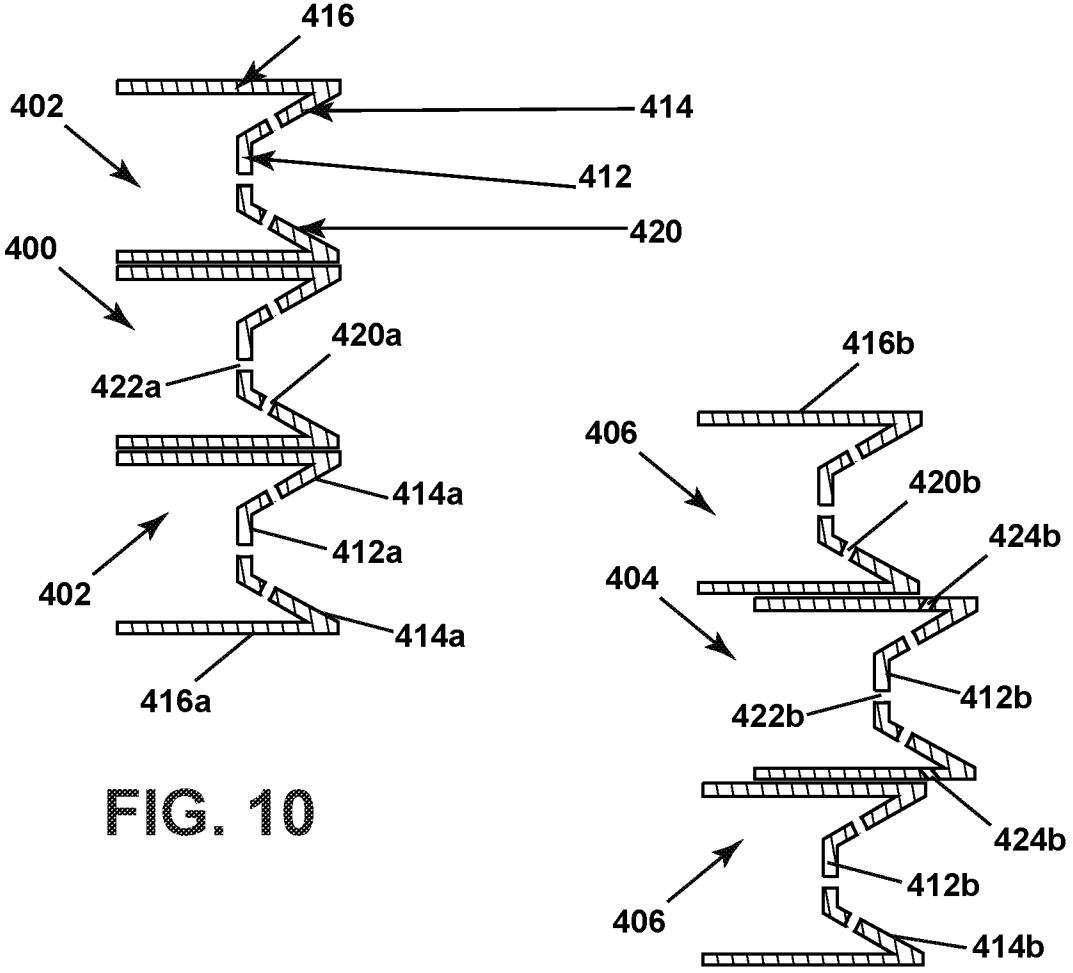
FIG. 10
FIG. 11
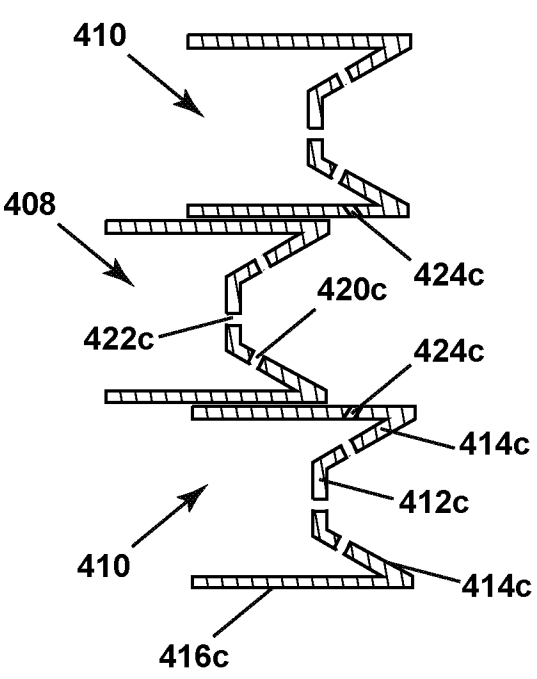
FIG. 12

GAS TURBINE NOZZLE HAVING AN INNER AIR SWIRLER PASSAGE AND PLURAL EXTERIOR FUEL PASSAGES

CROSS-REFERENCE TO RELATED APPLICATION(S)

This application claims priority to and the benefit of Indian Provisional Patent Application No. 202111059813, filed Dec. 21, 2021, the entirety of which is incorporated herein by reference.

FIELD

The present subject matter relates generally to combustor for a turbine engine, the combustor having one or both of a fuel nozzle and a swirler.

BACKGROUND

An engine, such as a turbine engine that includes a turbine, is driven by combustion gases of a combustible fuel within a combustor of the engine. The engine utilizes a fuel nozzle to inject the combustible fuel into the combustor. A swirler provides for mixing the fuel with air in order to achieve efficient combustion.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which:

FIG. 10 is a cross-sectional view of yet another alternative fuel nozzle assembly in accordance with an exemplary embodiment of the present disclosure.

FIG. 11 is a cross-sectional view of yet another alternative fuel nozzle assembly in accordance with an exemplary embodiment of the present disclosure.

FIG. 12 is a cross-sectional view of yet another alternative fuel nozzle assembly in accordance with an exemplary embodiment of the present disclosure.

DETAILED DESCRIPTION

Figure 1:
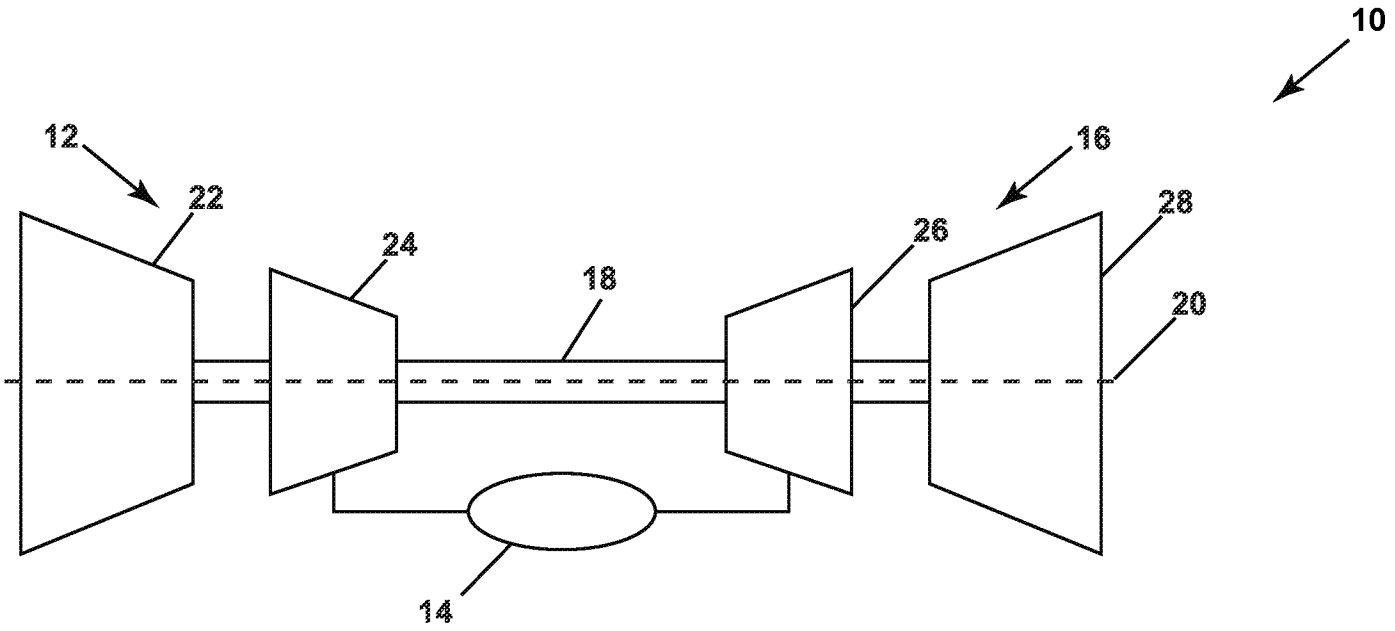
FIG. 1 is a schematic cross-sectional view of an engine in accordance with an exemplary embodiment of the present disclosure.

Aspects of the disclosure herein are directed to a fuel nozzle and swirler architecture located within an engine component, and more specifically to a fuel nozzle structure configured for use with heightened combustion engine temperatures. Such fuels can eliminate carbon emissions, but generate challenges relating to flame holding or flashback due to the higher flame speed and burn temperatures. Current combustors include a durability risk when using such fuels. For purposes of illustration, the present disclosure will be described with respect to a turbine engine for an aircraft with a combustor. It will be understood, however, that aspects of the disclosure herein are not so limited, and can have applicability in other residential, commercial, or industrial applications.

Reference will now be made in detail to the fuel nozzle and swirler architecture, and in particular for use with an engine, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

The term "flame holding" relates to the condition of continuous combustion of a fuel such that a flame is maintained along or near to a component, and usually a portion of the fuel nozzle assembly as described herein, and "flashback" relate to a retrogression of the combustion flame in the upstream direction.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, front, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

Approximating language, as used herein throughout the specification and claims, is applied to modify any quantitative representation that could permissibly vary without resulting in a change in the basic function to which it is related. Accordingly, a value modified by a term or terms, such as "about", "generally", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

A combustor introduces fuel from a fuel nozzle, which is mixed with air provided by a swirler, and then combusted within the combustor to drive the turbine. Increases in efficiency and reduction in emissions have driven the need to use fuel that burns cleaner or at higher temperatures. There is a need to improve durability of the combustor under these operating parameters, such as improved flame control to prevent flame holding on the fuel nozzle and swirler components.

During combustion, the engine generates high local temperatures. Efficiency and carbon emission needs require fuels that burn hotter and faster than traditional fuels, or that reduced carbon emissions require the use of fuels with higher burn temperatures like hydrogen for hydrogen fuel mixes. Such temperatures and burn speeds can be higher than that of current engine fuels, such that existing engine designs would include durability risks operating under the heightened temperatures required for heightened efficiency and emission standards.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16. A drive shaft 18 rotationally couples the compressor and turbine sections 12, 16, such that rotation of one affects the rotation of the other, and defines a rotational axis 20 for the turbine engine 10.

The compressor section 12 can include a low-pressure (LP) compressor 22, and a high-pressure (HP) compressor 24 serially fluidly coupled to one another. The turbine section 16 can include an HP turbine 26, and an LP turbine 28 serially fluidly coupled to one another. The drive shaft 18 can operatively couple the LP compressor 22, the HP compressor 24, the HP turbine 26 and the LP turbine 28 together. Alternatively, the drive shaft 18 can include an LP drive shaft (not illustrated) and an HP drive shaft (not illustrated). The LP drive shaft can couple the LP compressor 22 to the LP turbine 28, and the HP drive shaft can couple the HP compressor 24 to the HP turbine 26. An LP spool can be defined as the combination of the LP compressor 22, the LP turbine 28, and the LP drive shaft such that the rotation of the LP turbine 28 can apply a driving force to the LP drive shaft, which in turn can rotate the LP compressor 22. An HP spool can be defined as the combination of the HP compressor 24, the HP turbine 26, and the HP drive shaft such that the rotation of the HP turbine 26 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 26 at a downstream end of the combustion section 14.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the turbine engine 10 via an exhaust section (not illustrated) downstream of the turbine section 16. The driving of the LP turbine 28 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10.

Figure 2:
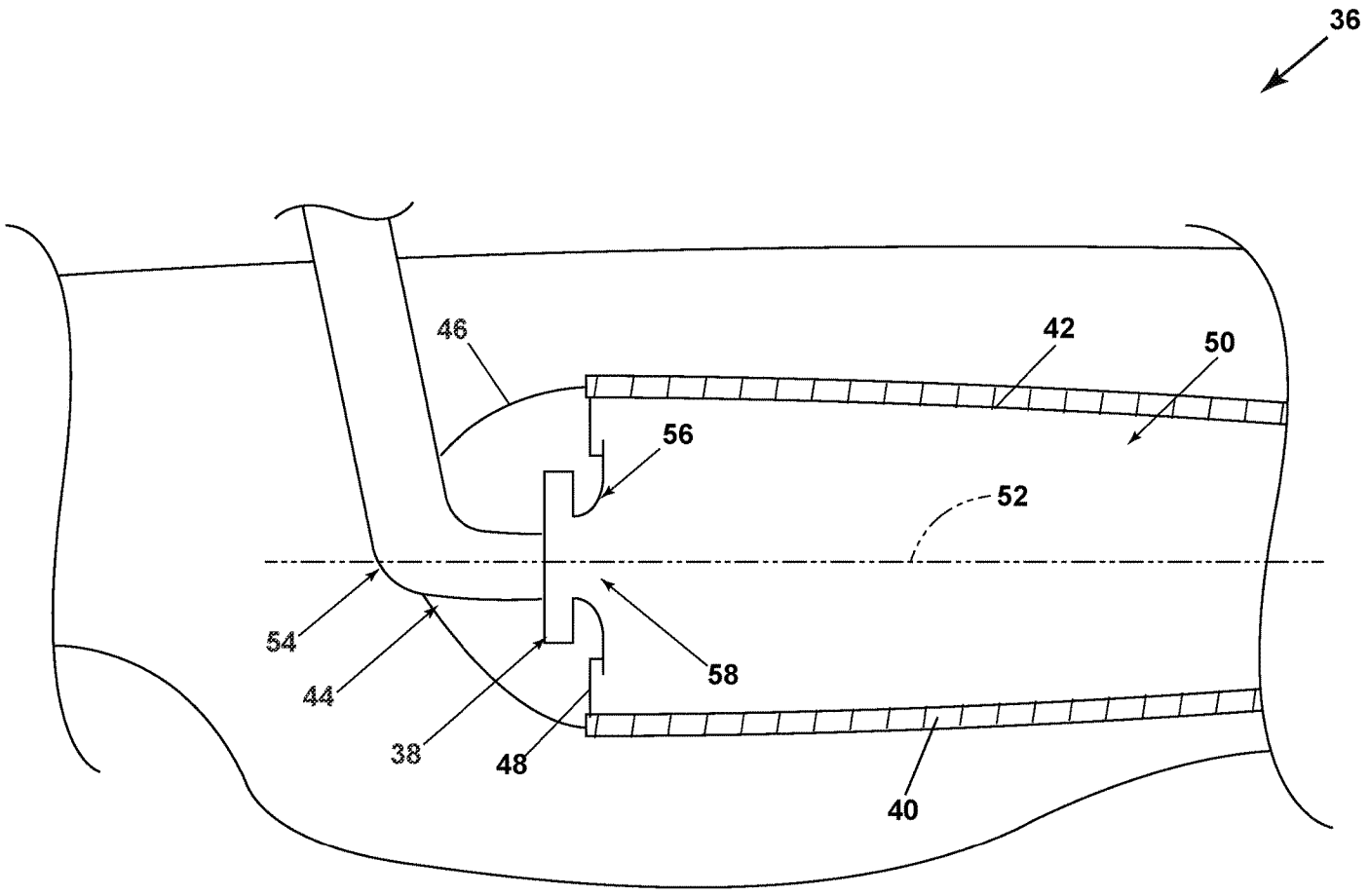
FIG. 2 is a schematic cross-sectional view of a combustor for the engine of FIG. 1 in accordance with an exemplary embodiment of the present disclosure.

FIG. 2 depicts a cross-sectional view of a generic combustor 36 suitable for use in the combustion section 14 of FIG. 1. The combustor 36 can include an annular arrangement of fuel nozzle assemblies 38 for providing fuel to the combustor 36. It should be appreciated that the fuel nozzle assemblies 38 can be organized in an annular arrangement including multiple fuel injectors, or in any other desired arrangement. The combustor 36 can have a can, can-annular, or annular arrangement depending on the type of engine in which the combustor 36 is located. The combustor 36 can include an annular inner combustor liner 40 and an annular outer combustor liner 42, a dome assembly 44 including a dome 46 and a deflector 48, which collectively define a combustion chamber 50 about a longitudinal axis 52. At least one fuel supply 54 is fluidly coupled to the combustion chamber 50 to supply fuel to the combustor 36. The fuel supply 54 can be disposed within the dome assembly 44 upstream of a flare cone 56 to define a fuel outlet 58. A swirler can be provided at the fuel nozzle assemblies 38 to swirl incoming air in proximity to fuel exiting the fuel supply 54 and provide a homogeneous mixture of air and fuel entering the combustor 36.

Figure 3:
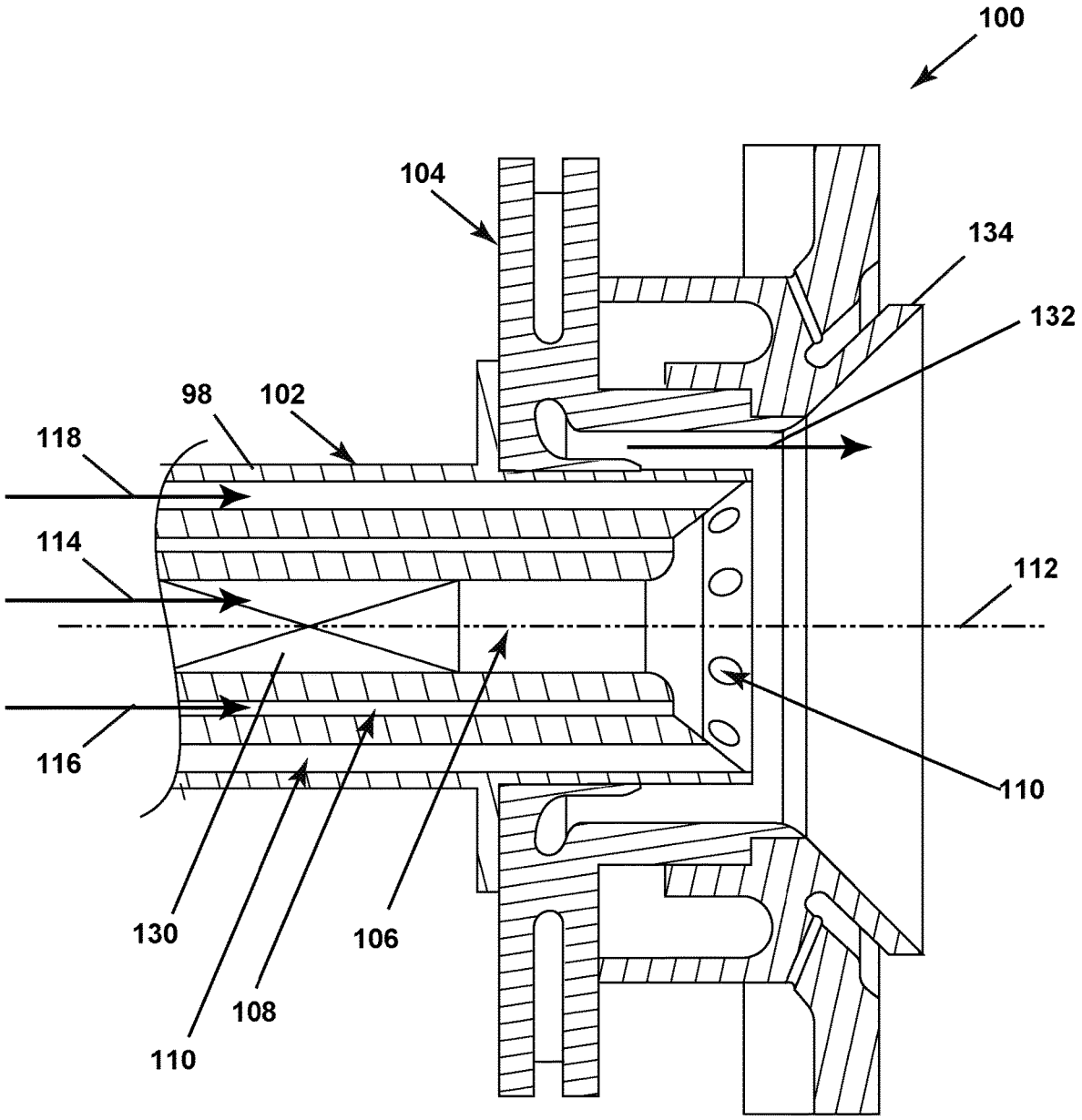
FIG. 3 is a cross-sectional view of a fuel nozzle assembly in accordance with an exemplary embodiment of the present disclosure.

FIG. 3 illustrates a cross section of a fuel nozzle assembly 100, suitable for use as the fuel nozzle assembly 38 of FIG. 2, including a fuel nozzle 102 with an outer wall 98, and a swirler 104 circumscribing the fuel nozzle 102. The fuel nozzle 102 can be cylindrical, and can include an inner passage 106, a middle passage 108, and an outer passage 110 relative to a longitudinal axis 112 defined along the fuel nozzle 102. The fuel nozzle 102 can be a hydrogen fuel nozzle, for example, configured to supply hydrogen fuel to a combustor, or a hydrogen-based fuel nozzle configured to supply hydrogen-based fuels to the combustors. An air supply 114 can be provided along the inner passage 106. The aft-end of the inner passage 106 can include a rounded profile, which can increase air-fuel interaction to promote mixing. A primary fuel supply 116 can be provided along the middle passage 108 and a secondary fuel supply 118 can be provided along the outer passage 110. It should be appreciated that the primary fuel supply 116 need not be limited to the middle passage 108, such that the primary or secondary fuel supplies can be switched, or even switched with the air supply 114 in the inner passage 106. In this way, the passages 106, 108, 110 can be tailored to supply either air or fuel, and may or may not impart a tangential component to supplies within the passages 106, 108, 110. Furthermore, differing fuels can be utilized in the primary and secondary fuel passages, such as using hydrogen for the primary fuel supply, and a hydrogen-mix or additive in the secondary fuel supply in one non-limiting example.

An interior swirler 130 can be provided within the inner passage 106 such that a tangential component is imparted to the air supply 114 to create a swirling airflow for the air supply 114. In a non-limiting example, the swirl number of the air from the interior swirler 130 can vary from 0.0 to 0.6, while a wider range is contemplated. The swirling airflow from the interior swirler 130 mixes with fuel, and more particularly the primary fuel supply 116 and the secondary fuel supply 118 at an exit of the inner passage 106, while the interior swirler 130 maintains sufficient axial momentum of the swirling air flow to push the flame away from the fuel nozzle 102, reducing flashback or flame holding at the fuel nozzle 102. The interior swirler 130 can be any suitable structure to impart the tangential component of flow, one such swirler is a set of vanes extending from a center body. As can be appreciated, the outer passage 110, as well as the middle passage 108, can be separated into multiple discrete passages or orifices in annular arrangement about the longitudinal axis 112, while it is contemplated that the inner passage 106 or the middle passage 108 can be arranged as a single annular passage, or combinations thereof in non-limiting examples.

In operation, emitting the swirling airflow from the inner passage 106 sandwiches the primary fuel supply 116 and the secondary fuel supply 118 between the air supply 114 and a swirler air supply 132, provided from the swirler 104. Sandwiching the primary and secondary fuel supplies 116, 118 maintains the fuel supply within the swirler air supply 132, which can reduce flame holding on an exterior flare cone 134, while swirl imparted to the air supply 114 by the interior swirler 130 can promote mixing of the fuel and air. Utilizing the primary fuel supply 116 and the secondary fuel supply 118 permits increased control of the supply of fuel to reduce or eliminate flame holding and flashback, as well as greater control of flame shape, which can be tailored to different operating conditions or engines.

Figure 4:
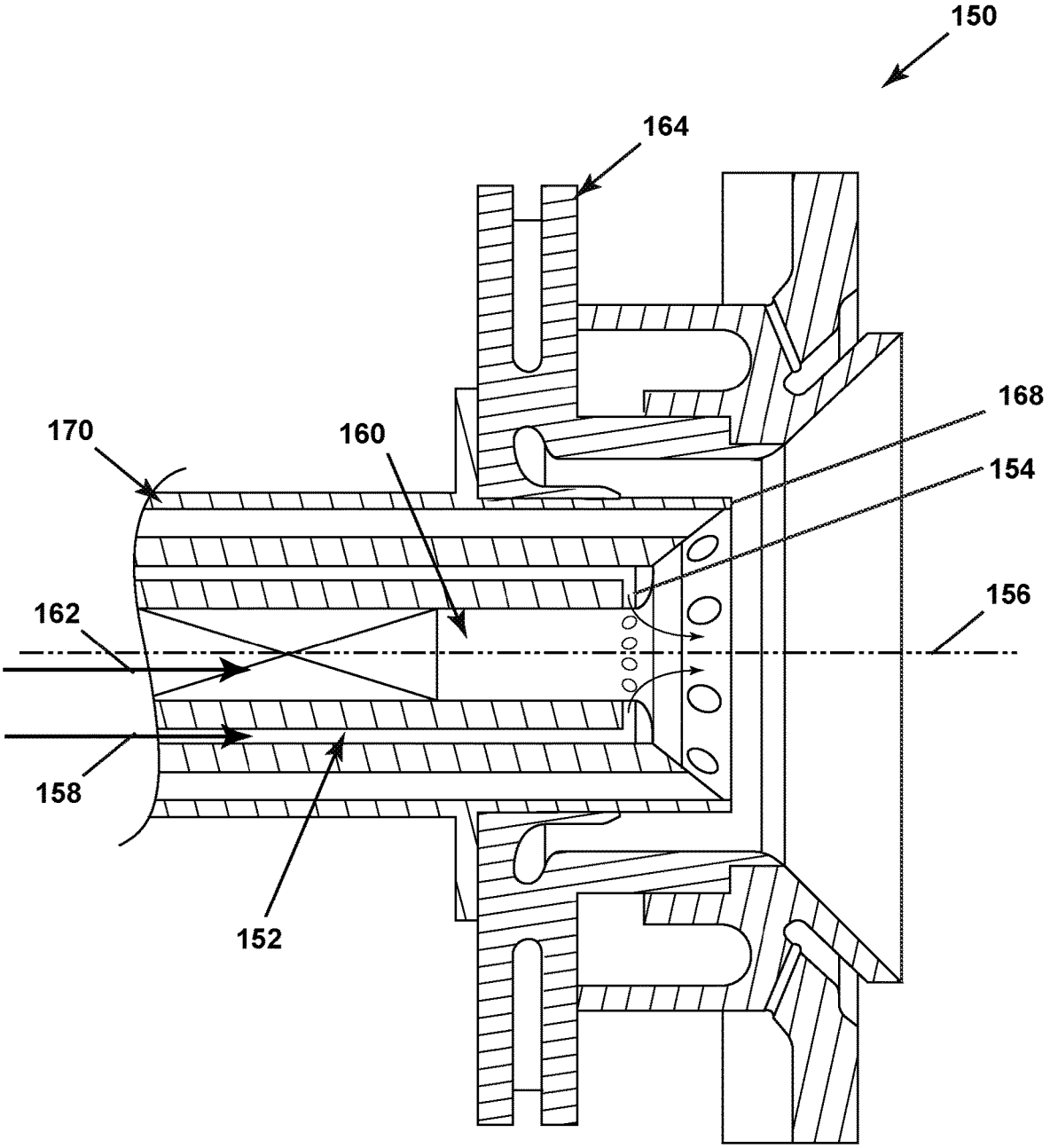
FIG. 4 is a cross-sectional view of an alternative fuel nozzle assembly in accordance with an exemplary embodiment of the present disclosure.

FIG. 4 shows an alternate fuel nozzle assembly 150 that can be substantially similar to the fuel nozzle assembly 100 of FIG. 3, including a swirler 164 and a fuel nozzle 170, except that a middle passage 152 includes radial orifices 154, relative to a longitudinal axis 156 defined along the fuel nozzle assembly 150. The middle passage 152, which can carry a primary fuel supply 158, can exhaust into an inner passage 160 through the radial orifices 154, which can be arranged orthogonal to the longitudinal axis 156, while an angular offset from orthogonal is contemplated, as is further described in regard to FIG. 6. In one non-limiting example, the radial orifices 154 can be oriented in a tangential direction, tangent to a ray extending from the longitudinal axis 156, to impart a swirl to the primary fuel supply 158, which can be aligned with or complementary to the swirl of airflow provided by the interior swirler 130 within the inner passage 160, while it is contemplated that the tangential orientation can be in same direction or counter to the swirl of the swirler in inner passage 160, where a co-swirl reduces shear and a counter-swirl increases fuel-air mixing. Furthermore, it is contemplated that the radial orifices 154 can be arranged anywhere on the fuel nozzle 170 axially up to an aft end 168 of the fuel nozzle 170, or in multiple rows or staggered patterns, in non-limiting examples, while any cross-sectional shape is contemplated.

An orthogonal introduction of the primary fuel supply 158 introduces the primary fuel as a crossflow into an airflow 162 provided within the inner passage 160. Introducing the fuel as a cross flow into the airflow 162 can increase mixing of the fuel and air by increasing mixing length forward of the nozzle aft end 168 of the fuel nozzle 170, and introducing the cross flow into swirling airflow from an interior swirler 172, which can be similar to the interior swirler 130 of FIG. 3, which can further increase mixing. In addition, the inner passage 160 provides the airflow 162 to push the flame aft, which can reduce or eliminate flame holding or flashback.

Figure 5:
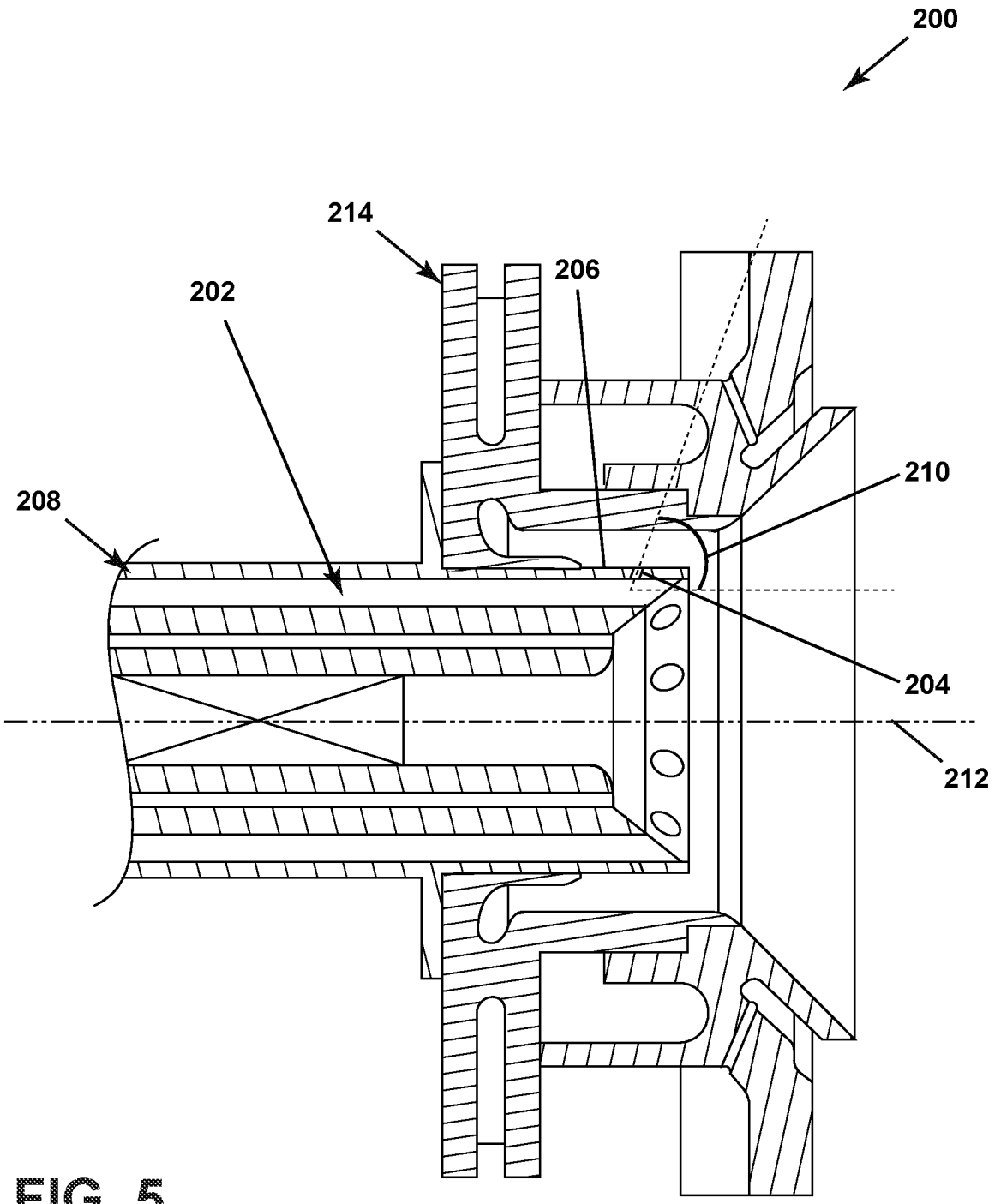
FIG. 5 is a cross-sectional view of another alternative fuel nozzle assembly in accordance with an exemplary embodiment of the present disclosure.

FIG. 5 shows another alternate fuel nozzle assembly 200 that can be substantially similar to the fuel nozzle assemblies 100, 150, of FIGS. 3 and 4, except that a set of outer passages 202 includes a set of fuel orifices 204 provided in an exterior surface 206 of a fuel nozzle 208. The set of fuel orifices 204 can be arranged at an angle 210 relative to a longitudinal axis 212. In one non-limiting example, the angle 210 can be offset from a radial axis extending perpendicular to the longitudinal axis 212. The angle 210 can be between 0-degrees and 90-degrees, where 0-degrees is aligned parallel to the longitudinal axis 212 and 90-degrees is orthogonal to the longitudinal axis 212. Alternatively, the angle can be non-zero, such that the orifices of the set of fuel orifices 204 are offset from either the radial or longitudinal axes. Furthermore, it is contemplated that the angle 210 can be oriented in a forward direction or an aft direction, where FIG. 5 shows the angle 210 oriented in the aft direction. Further still, it is contemplated that the angle 210 be in a tangential orientation, relative to the cylindrical shape of the fuel nozzle 208. In one example, the tangential arrangement of the angle 210 can be aligned with the swirl of an airflow provided from a swirler 214 circumscribing the fuel nozzle 208 to reduce shear or turbulence. In another example, the tangential orientation of the angle 210 can be counter to the swirl of the swirler 214 to improve mixing of a secondary fuel supply with the airflow from the swirler 214.

Figure 6:
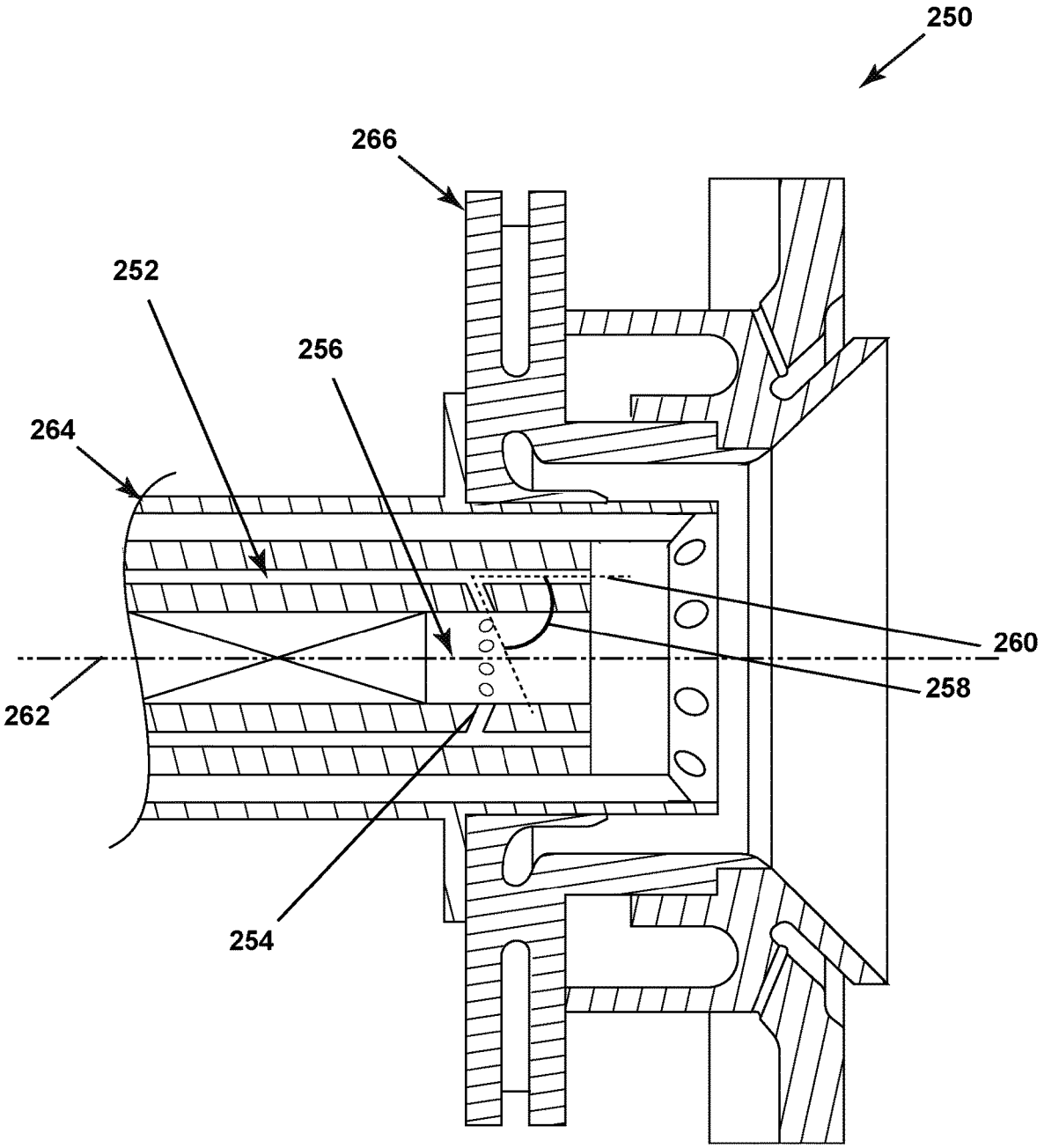
FIG. 6 is a cross-sectional view of yet another alternative fuel nozzle assembly in accordance with an exemplary embodiment of the present disclosure.

FIG. 6 shows yet another alternate fuel nozzle assembly 250 that can be substantially similar to the fuel nozzle assemblies 100, 150, 200 of FIGS. 3-5, except that a set of middle passages 252 include a set of fuel orifices 254 exhausting into an inner passage 256, similar to the fuel nozzle assembly 150 of FIG. 4, and that the set of fuel orifices 254 is arranged at an angle 258. The angle 258 can be defined relative to an orthogonal axis 260 extending parallel to a longitudinal axis 262 defined by a fuel nozzle 264. The angle can be between negative ninety-degrees (−90-degrees) and 90-degrees, where 0-degrees is parallel to the orthogonal axis 260, a negative angle represents orientation in a forward direction, and a positive angle represents orientation in an aft direction, relative to the engine 10 of FIG. 1. Furthermore, the angle 258 can be oriented in a tangential direction, such as emitting the fuel aligned with the swirl of airflow provided by a swirler 266 within the inner passage 256, while it is contemplated that the tangential orientation can be counter to the swirl of the swirler 266 to increase mixing.

The set of fuel orifices 254 can be provided at any axial position, such that the fuel exhausts into the swirler 266. Furthermore, the set of fuel orifices 254 can be arranged as subsets of orifices, such that they are offset, grouped, or patterned. It should be appreciated that the angle 258 for the set of fuel orifices 254 can inject additional fuel to increase mixing of fuel and air to decrease emissions, as well as reducing flame holding or flashback at the fuel nozzle assembly 250 with axial swirling flow through the inner passage 256.

Figure 7:
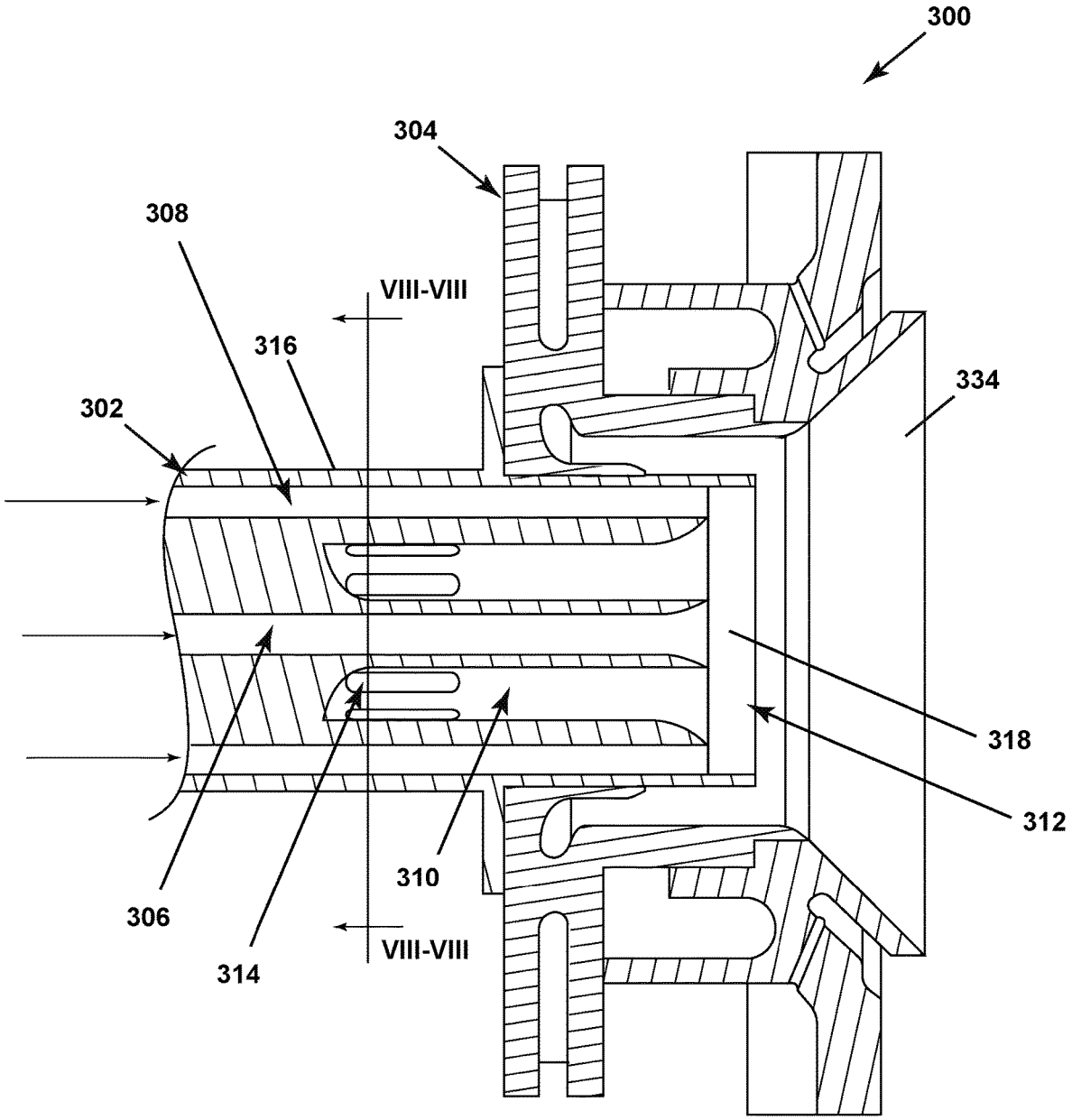
FIG. 7 is a cross-sectional view of yet another alternative fuel nozzle assembly in accordance with an exemplary embodiment of the present disclosure.

FIG. 7 shows another exemplary fuel nozzle assembly 300 including a fuel nozzle 302, a swirler 304, and flare cone 326. The fuel nozzle 302 can include a primary fuel passage 306 arranged centrally within the fuel nozzle 302 and an outer passage 308 arranged annularly about the primary fuel passage 306. An air passage 310 extends partially through the fuel nozzle 302, positioned radially between the primary fuel passage 306 and the outer passage 308, and exhausting at a fuel nozzle tip 312. A set of openings 314 extend through an outer wall 316 of the fuel nozzle 302 feeding the air passage 310, where the airflow through the air passage 310 is turned from a radial direction at the set of openings 314 to the axial direction along the air passage 310. The air provided through the air passage 310 permits uniform velocity for the velocity profile at the exit of the air passage 310 before interaction with the fuel. The openings 314 can have a racetrack shape, as shown, while other cross-sectional shapes are contemplated, such as circular, oval, squared, linear, curvilinear, curved, or combinations thereof in non-limiting examples. Additionally, any number of openings 314 are contemplated, while sets or subsets with different arrangements are further contemplated.

The outer passage 308 can feed a common slot 318 before exhausting from the fuel nozzle 302. The outer passage 308 can be formed as a set of discrete passages to provide space for the openings 314. Utilizing the slot 318 permits uniform provision of the fuel from the outer passage 308, while providing room for the openings 314.

Utilizing two fuel supplies via the primary fuel passage 306 and the outer passage 308 permits control of the fuel supply based upon operating conditions or the engine, which can reduce or eliminate flame holding on the fuel nozzle assembly 300 by keeping the flame further from the fuel nozzle assembly 300. Moreover, a secondary fuel supply provided in the outer passage 308 can provide for increased flame control in the radial direction, as well as utilizing the air passage 310 to centrally-maintain the primary fuel supply within the combustor.

Figure 8:
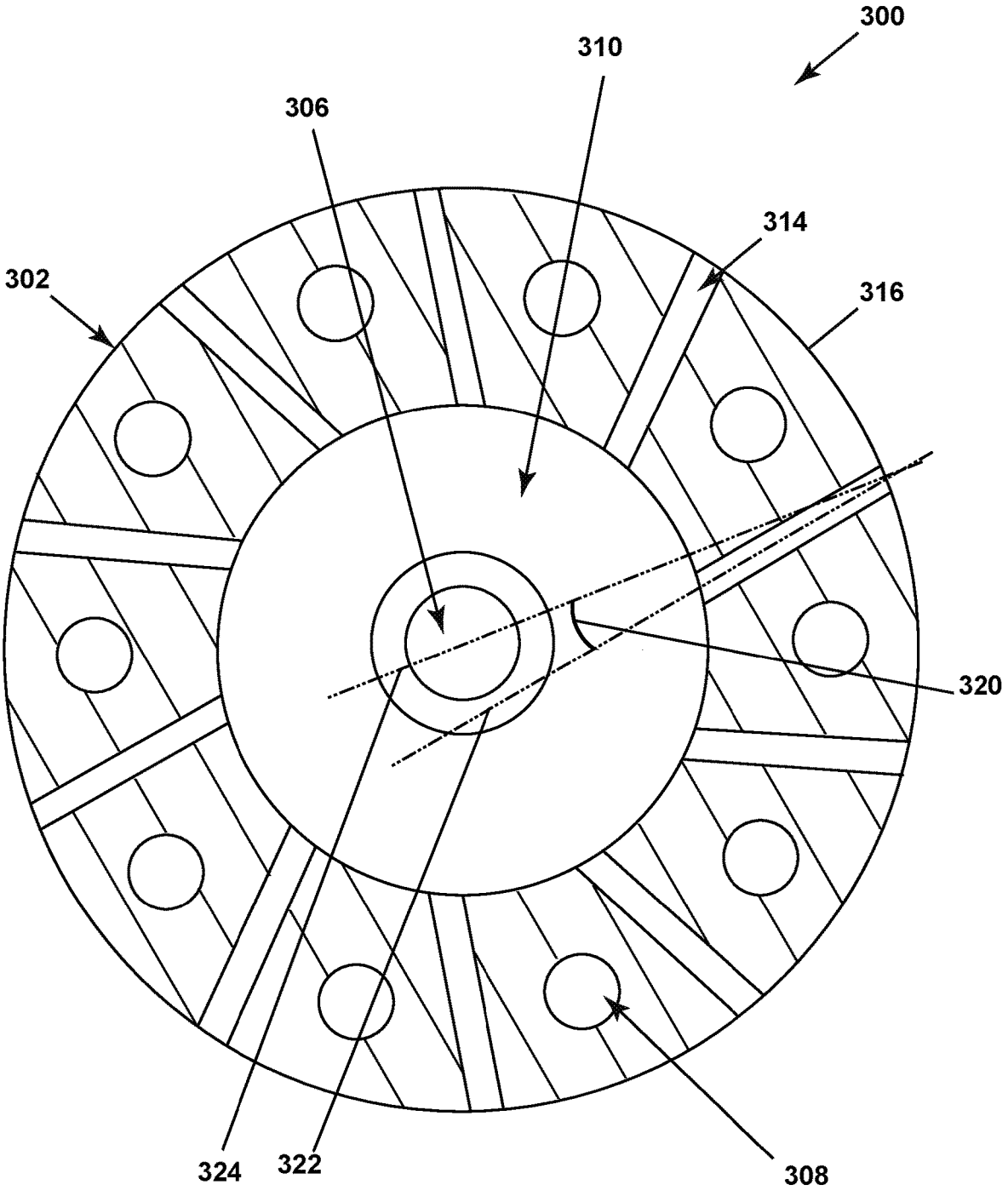
FIG. 8 is a cross-sectional view of the fuel nozzle assembly of FIG. 7 taken across section VIII-VIII in accordance with an exemplary embodiment of the present disclosure.

FIG. 8 shows a section view taken across section VIII-VIII of FIG. 7, looking in a forward direction. The primary fuel passage 306 is positioned centrally, circumscribed by the air passage 310. The fuel nozzle 302 includes the outer passages 308 arranged about the air passage 310 as discrete passages, which can be later fluidly coupled via the slot 318 seen in FIG. 7, while it is further contemplated that the primary fuel passage 306 and the outer passages 308 are fed from a common source. The openings 314 feeding the air passage 310 through the outer wall 316 are arranged at an angle 320 defined between a longitudinal opening axis 322 defined through the openings 314 and a radial axis 324. The angle 320 permits air provided to the air passage 310 to include a tangential component, or a swirl, extending in an axial direction. In alternative examples, the swirl can be imparted via a set of vanes, which may be provided in the openings 314 in one example, or vanes provided within the air passage 310 downstream of the openings 314. In a non-limiting example, the angle 320 can be arranged such that the swirl number of the air from openings 314 can vary from 0.0 to 0.6, while a wider range is contemplated. The lesser swirl from the openings 314, relative to swirl from the swirler 304, helps to maintain sufficient axial momentum of the flow in the air passage 310 to push the flame away from the fuel nozzle assembly 300 and hence reducing flashback or flame holding at the fuel nozzle assembly 300 and at the same time swirling air flow helps to improve the mixing of air with fuel at exit of the passage 310.

A swirling airflow within the air passage 310 and the secondary fuel supply provide for increased control of the fuel provision, which can provide improved flame control, as well as a reduction of flashback at the fuel nozzle. Additionally, the swirling airflow within the air passage 310 can improve mixing with the primary fuel supply from the primary fuel passage 306, while the swirler 304 prevents flame holding on an exterior flare cone 326 or other fuel nozzle assembly components. Further still, it is contemplated that the primary fuel passage 306 can include a swirling feature, such as a vane or airfoil, to impart a swirl to the primary fuel supply. Additionally, the secondary fuel supply in the outer passages 308 can include a tangential component or swirl, which can reduce shear between adjacent fluid supplies where swirls are aligned or in the same direction, or can improve fuel-air mixture. In this way, it should be appreciated that a swirl in either a clockwise or counter-clockwise direction for any one or more of the primary fuel passage 306 and the outer passages 308 is contemplated, for either or both of the fuel or air supplies, which can tailor the velocity profile for the fuel nozzle assembly 300 to reduce flame holding or flashback, while improving fuel and air mixing.

Figure 9:
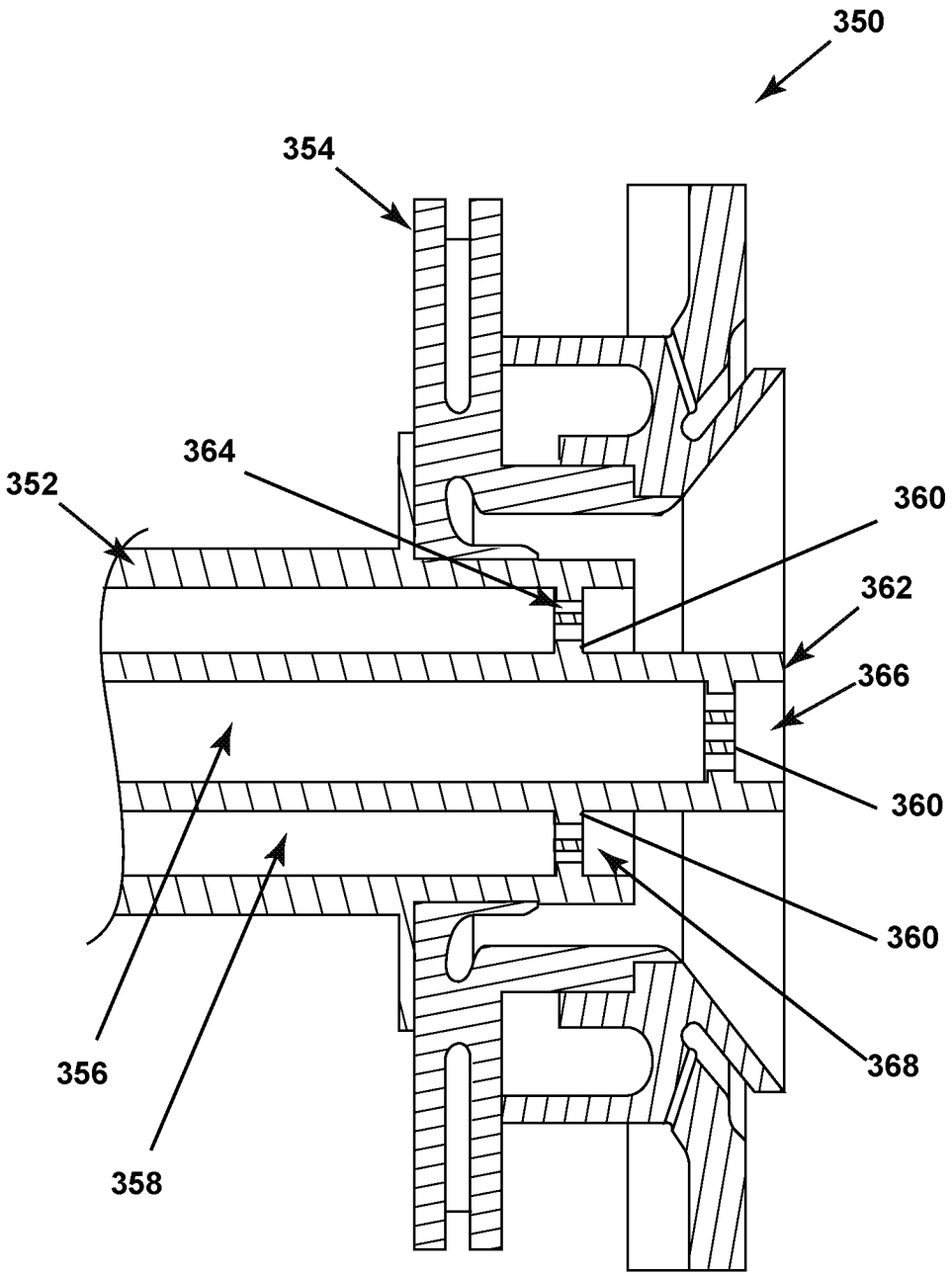
FIG. 9 is a cross-sectional view of yet another alternative fuel nozzle assembly in accordance with an exemplary embodiment of the present disclosure.

FIG. 9 includes a fuel nozzle assembly 350 with a fuel nozzle 352 and a swirler 354 circumscribing the fuel nozzle 352. The fuel nozzle 352 includes a primary fuel passage 356 and an annular secondary fuel passage 358 circumscribing the primary fuel passage 356. The primary and secondary fuel passages 356, 358 each include nozzle caps 360 provided therein spaced from a nozzle tip 362. Fuel orifices 364 are provided in the nozzle caps 360 to permit fuel egress from the fuel nozzle 352. The fuel orifices 364 can be axial, or can include a tangential component to impart a swirl to the fuel supply. Any cross-sectional shape for the fuel orifices 364 is contemplated, such as racetrack, circular, oval, elliptical, linear, non-linear, curved, curvilinear, or combinations thereof in non-limiting examples. It is also contemplated that there can be any number of fuel orifices 364 in any arrangement, such as sets or subsets of orifices or arrangements thereof, such as patterns or groups.

The primary fuel passage 356 includes a primary outlet 366 and the secondary fuel passage 358 includes a secondary outlet 368, with the nozzle tip 362 collectively formed at the primary and secondary outlets 366, 368. The primary outlet 366 is positioned axially aft of the secondary outlet 368, such that a stepped profile is defined at the nozzle tip 362 by the primary outlet 366 and the secondary outlet 368.

The stepped profile permits greater fuel flow control permitting greater flame shape control, as opposed to a fuel nozzle with only a primary fuel provision. The fuel orifices 364 for both the primary fuel passage 356 and the secondary fuel passage 358 can be arranged axially, or can include a tangential component to impart a swirl to fuel provided from the primary or secondary fuel passages 356, 358, respectively. The area of the primary and secondary fuel passages 356, 358 downstream of the fuel orifices 364 helps to mix the fuel coming for different fuel orifices 364 and create uniform fuel velocity before interacting with adjacent stream or other fuel or air streams. Such a uniform velocity avoids any low velocity region to reduce or eliminate flame holding at the fuel nozzle assembly 350. It is also contemplated that in another embodiment there are no nozzle caps 360 with no orifices 364.

Referring to FIGS. 10-12, it should be appreciated that different arrangements between the primary fuel supply and the secondary fuel supply are contemplated, such that the axial positioning can vary between outlets for the primary and secondary fuel supplies. FIG. 10 shows a primary fuel supply 400 can be axially aligned with an annular secondary fuel supply 402, FIG. 11 shows a primary fuel supply 404 axially aft of a secondary fuel supply 406, similar to that as shown in FIG. 9, FIG. 12 shows a primary fuel supply 408 axially forward of a secondary fuel supply 410. Each of FIGS. 10-12 include an outer wall 416, a pair of angled walls 414, and a cap wall 412 between the angled walls 414, with FIG. 10 including an outer wall 416*a*, angled walls 414*a*, and a cap wall 416*a*, FIG. 11 including an outer wall 416*b*, angled walls 414*b*, and a cap wall 412*a*, FIG. 12 including an outer wall 416*c*, angled walls 414*c*, and a cap wall 412*c*.

Additionally, each of the fuel supplies 400, 402, 404, 406, 408, 410 can include an outlet or set of orifices 420, 422, with FIG. 10 including orifices 420*a* in the angled walls 414*a* and orifices 422*a* in the center wall 412*a*, FIG. 11 including orifices 420*b* in the angled walls 414*b*, orifices 422*b* in the center wall 412*b*, and orifices 424*b* in the outer wall 416*b*, and FIG. 12 including a set of orifices 420*c* in the angled walls 414*c*, orifices in the cap wall 412*c*, and orifices 424*c* in the outer walls 416*c*. In FIG. 10, the outer walls 416*a* of each of the primary and secondary fuel supply 400, 402 are aligned, while the outer walls 416*b-c* of FIGS. 11-12 are offset. More specifically, in FIG. 11, as the primary fuel supply 404 extends aft, portions of the outer wall 416*b* for the primary fuel supply 404 are exposed, such that additional orifices 424*b* can extend through the outer wall 416*b* of the primary fuel supply 404, which can improve radial spread of the primary fuel supply. In FIG. 12, portions of the outer wall 416*c* for the secondary fuel supply 410 are exposed, such that additional orifices 424*c* can extend through the outer wall 416*c* of the secondary fuel supply 410, which can limit the spread of the primary fuel supply, which can eliminate flashback and improve flame shape within the combustor. These arrangements can be utilized to vary and achieve the desired fuel profile, or flame shape, through effective fuel distribution to improve interaction with adjacent swirling flows, such as that of the swirler, to reduce flame holding. It should be understood that the axial stagger for the primary and secondary fuel supplies 400, 402, 404, 406, 408, 410 further increases flame shape control and positioning, which can further reduce or eliminate flame holding.

The aspects for FIGS. 10-12 further provide for two fuel circuits, which give an additional level of control to cover various fuel provisions for various operating conditions. Further still, utilizing the additional orifices 424*b-c* provides for different combinations or injection patterns between the primary and secondary nozzles 400, 402, 404, 406, 408, 410, which can be used to control distribution of the fuel, or define particular distribution patterns. Furthermore, it is contemplated that both the primary and secondary fuel passages 400, 402, 404, 406, 408, 410, or the orifices 420, 422, 424 therein, can be arranged as axial or tangential, where a tangential arrangement can be arranged tangent to a radius defined by the primary fuel passage 400, 404, 408 to impart a swirl to the fuel. Furthermore, such a tangential orientation can reduce or eliminate low velocity regions among the primary fuel nozzle 400, 404, 408 and the secondary fuel nozzle 402, 406, 410, and promote effective interaction with the swirling air from the swirler to reduce or eliminate flashback.

Figure 13:
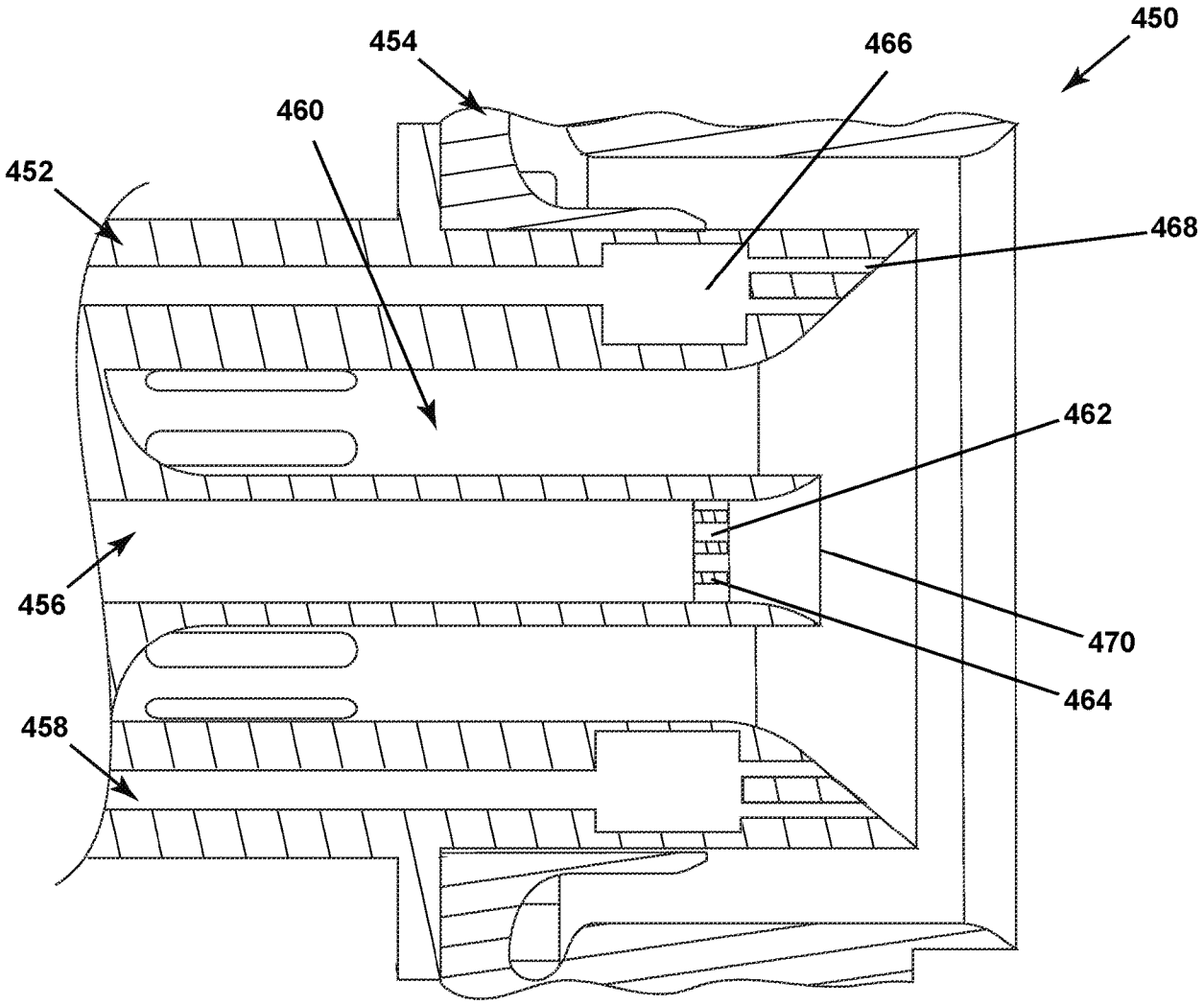
FIG. 13 is a cross-sectional view of yet another alternative fuel nozzle assembly in accordance with an exemplary embodiment of the present disclosure.

FIG. 13 shows another exemplary fuel nozzle assembly 450 including a fuel nozzle 452 circumscribed by a swirler 454 (only partially shown). The fuel nozzle 452 can include a primary fuel passage 456 and a secondary fuel passage 458 circumscribing the primary fuel passage 456. An air passage 460 can be provided between the primary and secondary fuel passages 456, 458, fed in a manner similar to that of FIG. 8. The primary fuel passage 456 includes a nozzle cap 462 with a set of fuel orifices 464 permitting fuel to exhaust from the primary fuel passage 456. The secondary fuel passage 458 can includes an annular fuel plenum 466, which can be common to all secondary fuel passages 458. A set of secondary fuel orifices 468 extend axially from the plenum 466 permitting exhausting of the secondary fuel supply.

Utilizing the fuel plenum 466 provides space to have multiple rows of fuel orifices, and different combination of fuel orifices between or among said rows, which helps to improve uniform fuel distribution through set of secondary fuel orifices 468 from the secondary fuel passages 458. Such distribution improves mixing upon interaction with an adjacent swirling air flow, while providing for the air passage 460 to be fed through the wall of the fuel nozzle 452. The distributed fuel flow through set of secondary fuel orifices 468 further reduces or eliminates low velocity pockets on or at a fuel nozzle tip 470, reducing flame holding. Additionally, the fuel orifices 464 or the secondary fuel orifices 468 can be axial or tangential to impart a swirl to the fuel supplies. Space for the primary fuel passages 456 downstream of the fuel orifices 464, but upstream of the nozzle tip 470, provides a more-uniform fuel velocity before interacting with adjacent stream or other fuel or air streams. Such a uniform velocity avoids any low velocity region to reduce or eliminate flame holding at the fuel nozzle assembly 450. It is also contemplated that in another embodiment there are no nozzle caps 462 with no fuel orifices 464.

It should be appreciated that fuels with higher burn temperature and higher burn speeds, or lighter weights relative to air or other fuels, can provide for reducing or eliminating emissions, or improving efficiency without increasing emissions. In one example, hydrogen fuels or hydrogen-based fuels can be utilized, which can eliminate carbon emissions without negative impact to efficiency. Such fuels, including hydrogen, require greater flame control, in order to prevent flame holding or flashback on the combustor hardware. The aspects described herein can increase combustor durability, while current combustors fail to provide durability to utilize such fuels.

It should be appreciated that the examples used herein are not limited specifically as shown, and a person having skill in the art should appreciate that aspects from one or more of the examples can be intermixed with one or more aspect from other examples to define examples that can differ from the examples as shown.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects are provided by the subject matter of the following clauses: a turbine engine comprising: a compressor section, combustor section, and turbine section in serial flow arrangement, with the combustor section including a fuel nozzle assembly comprising: an annular swirler; and a fuel nozzle having an outer wall, defining a longitudinal axis, and extending through the swirler, the fuel nozzle comprising: an inner passage; and an outer passage circumscribing the inner passage.

The turbine engine of any preceding clause, further comprising a swirler provided within the inner passage.

The turbine engine of any preceding clause, wherein fuel nozzle is configured to provide a hydrogen or hydrogen-based fuel.

The turbine engine of any preceding clause, wherein the fuel nozzle further comprising a third passage radially exterior of the outer passage.

The turbine engine of any preceding clause, wherein the third passage is arranged as a set of passages in annular arrangement about the outer passage.

The turbine engine of any preceding clause, wherein each passage of the set of passages includes an outlet orifice extending through the outer wall of the fuel nozzle.

The turbine engine of any preceding clause, wherein the outlet orifice for each passage of the set of passages is arranged at an angle offset from a radial axis extending perpendicular to the longitudinal axis.

The turbine engine of any preceding clause, wherein the outer passage is arranged as a set of discrete passages.

The turbine engine of any preceding clause, wherein each passage of the set of discrete passages includes a radial orifice aligned with a radius extending from the longitudinal axis.

The turbine engine of any preceding clause, wherein the radial orifice for each passage of the set of passages exhausts to the inner passage.

The turbine engine of any preceding clause, wherein the radial orifice for each passage of the set of passages is arranged at an angle.

A fuel nozzle assembly comprising: an annular swirler; and a fuel nozzle having an outer wall, defining a longitudinal axis, and extending through the swirler, the fuel nozzle comprising: an inner passage; and an outer passage in annular arrangement about the inner passage; and an air passage provided between the inner passage and the outer passage.

The fuel nozzle assembly of any preceding clause, further comprising a set of openings provided in the outer wall and exhausting to the air passage.

The fuel nozzle assembly of any preceding clause, the outer passage is arranged as a set of discrete passages.

The fuel nozzle assembly of any preceding clause, wherein each opening of the set of openings is provided between adjacent discrete passages of the set of discrete passages.

The fuel nozzle assembly of any preceding clause, wherein the set of openings are arranged at an angle relative to a radius extending perpendicular to the longitudinal axis.

The fuel nozzle assembly of any preceding clause, wherein the outer passage includes a plenum.

The fuel nozzle assembly of any preceding clause, further comprising a second set of orifices extending from the plenum.

A fuel nozzle assembly comprising: an annular swirler; and a fuel nozzle having an outer wall, defining a longitudinal axis, and extending through the swirler, the fuel nozzle comprising: an inner passage; and an outer passage in annular arrangement about the inner passage; and an air passage provided within the outer passage.

The fuel nozzle assembly of any preceding clause, wherein the air passage is provided between the inner passage and the outer passage.

The fuel nozzle assembly of any preceding clause, further comprising a set of openings extending through the outer wall and fluidly coupled to the air passage.

The fuel nozzle assembly of any preceding clause, wherein the outer passage is arranged as a set of discrete outer passages, and the set of openings extend between the set of discrete outer passages.

The fuel nozzle assembly of any preceding clause, wherein the air passage is provided within the inner passage.

The fuel nozzle assembly of any preceding clause, further comprising a swirler provided within the air passage.

A fuel nozzle assembly comprising: an annular swirler; and a fuel nozzle, defining a longitudinal axis and extending through the swirler, the fuel nozzle assembly comprising: an inner passage with a first set of outlets; and a outer passage in annular arrangement about the inner passage with a second set of outlets.

The fuel nozzle assembly of any preceding clause, further comprising a nozzle cap provided within the inner passage, with the first set of outlets provided in the nozzle cap.

The fuel nozzle assembly of any preceding clause, further comprising a outer nozzle cap provided within the outer passage, with the second set of outlets provided in the outer nozzle cap.

The fuel nozzle assembly of any preceding clause, wherein the inner passage extends aft of the outer passage.

The fuel nozzle assembly of any preceding clause, wherein the inner passage terminates forward of the outer passage.

The fuel nozzle assembly of any preceding clause, wherein the inner passage includes an outer wall and a set of additional orifices extend through the outer wall.

A turbine engine comprising: a compressor section, combustor section, and turbine section in serial flow arrangement, with the combustor section including a fuel nozzle assembly comprising: a fuel nozzle having an outer wall defining a longitudinal axis, and the fuel nozzle includes an inner passage and an outer passage circumscribing the inner passage.

The turbine engine of any preceding clause wherein the outer passage is arranged as a set of discrete outer passages.

The turbine engine of any preceding clause wherein the outer passage exhausts from the fuel nozzle aft of the inner passage.

The turbine engine of any preceding clause further comprising a set of radial orifices extending from the inner passage.

The turbine engine of any preceding clause wherein the inner passage is arranged as a set of inner passages complementary to the set of radial orifices.

The turbine engine of any preceding clause further comprising an air passage provided within the inner passage.

The turbine engine of any preceding clause wherein the set of radial orifices couple the inner passage to the air passage.

The turbine engine of any preceding clause wherein the set of radial orifices are arranged at an angle relative to an axis parallel to the longitudinal axis.

The turbine engine of any preceding clause wherein the fuel nozzle terminates at a nozzle tip, and wherein the inner passage terminates at the nozzle tip.

The turbine engine of any preceding clause further comprising a swirler provided within the air passage.

The turbine engine of any preceding clause further comprising a set of orifices extending from the outer passage through the outer wall.

The turbine engine of any preceding clause wherein the inner passage terminates at a primary outlet and the outer passage terminates at a secondary outlet.

The turbine engine of any preceding clause wherein the primary outlet is positioned aft of the secondary outlet.

The turbine engine of any preceding clause wherein the primary outlet is defined by a primary outlet wall, and a set of primary outlet wall orifices extend through the primary outlet wall.

The turbine engine of any preceding clause wherein the set of primary outlet wall orifices are positioned aft of the secondary outlet.

The turbine engine of any preceding clause wherein the secondary outlet is positioned aft of the primary outlet.

The turbine engine of any preceding clause wherein the secondary outlet is defined by a secondary outlet wall, and a set of secondary outlet wall orifices extend through the secondary outlet wall.

The turbine engine of any preceding clause wherein the set of secondary outlet wall orifices are positioned aft of the primary outlet.

The turbine engine of any preceding clause wherein the primary outlet and the secondary outlet are aligned.

The turbine engine of any preceding clause wherein at least one of the inner passage or the outer passage includes a nozzle cap.

The turbine engine of any preceding clause wherein the nozzle cap includes a set of orifices.

The turbine engine of any preceding clause wherein the nozzle cap includes a cap wall.

The turbine engine of any preceding clause wherein the nozzle cap further includes an angled wall extending between the cap wall and the outer wall.

The turbine engine of any preceding clause further comprising a plenum provided in the outer passage.

The turbine engine of any preceding clause further comprising a set of secondary outlets exhausting from the plenum.

The turbine engine of any preceding clause further comprising an air passage.

The turbine engine of any preceding clause wherein the air passage is positioned within the outer passage.

The turbine engine of any preceding clause wherein the air passage is positioned within the inner passage.

The turbine engine of any preceding clause wherein a swirler is provided within the air passage.

The turbine engine of any preceding clause further comprising a swirler circumscribing the fuel nozzle assembly.

The turbine engine of any preceding clause wherein the air passage is positioned between the inner passage and the outer passage.

The turbine engine of any preceding clause further comprising a set of openings extending through the outer wall and coupling to the air passage.

The turbine engine of any preceding clause wherein the set of openings are arranged at an angle, relative to a radius extending from the longitudinal axis.

A fuel nozzle assembly comprising: an annular swirler; and a fuel nozzle having an outer wall, defining a longitudinal axis, and extending through the swirler, the fuel nozzle comprising: an inner passage; and an outer passage in annular arrangement about the inner passage.

The fuel nozzle assembly of any preceding clause, wherein the fuel nozzle further comprises a third passage radially exterior of the outer passage.

The fuel nozzle assembly of any preceding clause, wherein the third passage is arranged as a set of discrete passages in annular arrangement about the outer passage.

The fuel nozzle assembly of any preceding clause wherein the inner passage comprises an air passage.

The fuel nozzle assembly of any preceding clause, wherein the air passage is provided between the inner passage and the outer passage.

The fuel nozzle assembly of any preceding clause, further comprising a set of openings extending through the outer wall and fluidly coupled to the air passage.

The fuel nozzle assembly of any preceding clause, wherein the outer passage is arranged as a set of discrete outer passages, and the set of openings extend between the set of discrete outer passages.

The fuel nozzle assembly of any preceding clause, further comprising an air passage provided within the inner passage.

The fuel nozzle assembly of any preceding clause, further comprising a swirler provided within the air passage.

A method of supplying fuel to a combustion chamber of a gas turbine engine, the method comprising: emitting an annulus of swirling air into the combustion chamber; injecting a primary fuel into the combustion chamber within the annulus of swirling air; and injecting a secondary fuel into the into the combustion chamber within the annulus of swirling air.

The method of any preceding clause, further comprising emitting a second annulus of swirling air within the annulus of swirling air.

The method of any preceding clause, wherein the second annulus of swirling air is provided within the primary fuel and the secondary fuel.

The method of any preceding clause, wherein the secondary fuel is injected as a set of secondary fuel flows from a set of secondary orifices.

The method of any preceding clause, wherein the primary fuel is injected as a set of primary fuel flows from a set of primary orifices.

The method of any preceding clause, wherein the set of primary fuel flows are injected at an angle relative to a flow direction of the primary fuel.

The method of any preceding clause, further comprising emitting a secondary annulus of swirling air.

The method of any preceding clause, wherein the secondary annulus of air is provided between the primary fuel and the secondary fuel.

The method of any preceding clause, wherein secondary annulus of air includes a tangential component, such that the secondary annulus of air is swirling.

The method of any preceding clause, wherein the primary fuel is injected aft of the secondary fuel.

The method of any preceding clause, further comprising emitting at least a portion of one of the primary fuel and the secondary fuel, into the other of the primary fuel and the secondary fuel.

The method of any preceding clause, further comprising providing the secondary fuel to a plenum prior to injecting the secondary fuel.

We claim:

1. A turbine engine comprising:

a compressor section, combustor section, and turbine section in serial flow arrangement, with the combustor section including a fuel nozzle assembly comprising:

an annular swirler; and a fuel nozzle having an outer wall and an outlet, the fuel nozzle defining a longitudinal axis and extending through the swirler, the fuel nozzle comprising:

an inner air passage terminating at an aft end, the inner air passage having a first constant cross-sectional area extending forward from the aft end; and a first fuel passage circumscribing the inner air passage, terminating at a first fuel passage outlet, and having a second constant cross-sectional area extending forward from the first fuel passage outlet; and a second fuel passage circumscribing the first fuel passage, terminating at a second fuel passage outlet, and having a third constant cross-sectional area extending forward from the second fuel passage outlet;

wherein the first fuel passage and the second fuel passage terminate aft of the inner air passage.

2. The turbine engine of claim 1 further comprising a swirler provided within the inner air passage.

3. The turbine engine of claim 1 wherein the fuel nozzle is a hydrogen fuel nozzle or a hydrogen-based fuel nozzle.

4. The turbine engine of claim 1 wherein the second fuel passage is arranged as a set of discrete passages in annular arrangement about the first fuel passage.

5. The turbine engine of claim 1 wherein the second fuel passage terminates aft of the first fuel passage.

6. The turbine engine of claim 1 wherein the inner air passage is fluidly isolated from the first fuel passage and the second fuel passage upstream of the outlet.

7. The turbine engine of claim 1 wherein the inner air passage includes a rounded profile at the aft end.

8. The turbine engine of claim 7 wherein the first constant cross-sectional area for the inner air passage is positioned forward of the rounded profile.

9. The turbine engine of claim 1 wherein at least a portion of the annular swirler includes a fourth constant cross-sectional area.

10. The turbine engine of claim 9 wherein the fourth constant cross-sectional area of the annular swirler radially overlaps at least one of the inner air passage, the first fuel passage, or the second fuel passage defined perpendicular to the longitudinal axis.

11. The turbine engine of claim 1 wherein the second fuel passage is immediately exterior of the first fuel passage.

12. A fuel nozzle assembly comprising:

an annular swirler; and a fuel nozzle having an outer wall, defining a longitudinal axis, and extending through the swirler, the fuel nozzle comprising:

an inner air passage terminating at an aft end, the inner air passage having a first constant cross-sectional area extending forward from the aft end;

a first fuel passage in annular arrangement about the inner air passage terminating at a first fuel passage outlet, and having a second constant cross-sectional area extending forward from the first fuel passage outlet; and a second fuel passage in annular arrangement about the first fuel passage terminating at a second fuel passage outlet, and having a third constant cross-sectional area extending forward from the second fuel passage outlet;

wherein the first fuel passage and the second fuel passage terminate aft of the inner air passage.

13. The fuel nozzle assembly of claim 12 wherein the second fuel passage is arranged as a set of discrete passages in annular arrangement about the first fuel passage.

14. The fuel nozzle assembly of claim 12 further comprising a set of openings extending through the outer wall and fluidly coupled to the inner air passage.

15. The fuel nozzle assembly of claim 14 wherein the second fuel passage is arranged as a set of discrete outer passages, and the set of openings extend between the set of discrete outer passages.

* * * * *